US006845918B2

(12) United States Patent
Rotondo

(10) Patent No.: US 6,845,918 B2
(45) Date of Patent: Jan. 25, 2005

(54) REMOTE THERMOSTAT FOR ROOM AIR CONDITIONER

(76) Inventor: John A. Rotondo, 4 Davis La., Westport, CT (US) 06880

( * ) Notice: Subject to any disclaimer, the term of this patent is extended or adjusted under 35 U.S.C. 154(b) by 0 days.

(21) Appl. No.: 10/611,511

(22) Filed: Jul. 1, 2003

(65) Prior Publication Data

US 2004/0011878 A1 Jan. 22, 2004

Related U.S. Application Data

(60) Provisional application No. 60/396,215, filed on Jul. 16, 2002.

(51) Int. Cl.[7] ..... G05D 23/00; F23N 5/20

(52) U.S. Cl. ..... 236/46 R; 236/51; 62/231; 62/262

(58) Field of Search ..... 236/47, 51, 1 R, 236/46 R; 165/268; 62/231, 262, 157

(56) References Cited

U.S. PATENT DOCUMENTS

| | | | | |
|---|---|---|---|---|
| 2,913,552 A | * | 11/1959 | Roberts | 337/66 |
| 3,486,081 A | | 12/1969 | Kanbar | 317/132 |
| 3,785,165 A | | 1/1974 | Valenzuela | 62/158 |
| 4,079,366 A | * | 3/1978 | Wong | 340/309.4 |
| 5,294,838 A | | 3/1994 | Juravich | 307/117 |
| 5,839,654 A | | 11/1998 | Weber | 236/47 |
| 5,930,097 A | | 7/1999 | Ceola et al. | 361/103 |

* cited by examiner

*Primary Examiner*—Harry B. Tanner
(74) *Attorney, Agent, or Firm*—St. Onge Steward Johnston & Reens LLC

(57) ABSTRACT

An air conditioner control assembly for use with a room air conditioner having an electrical plug adapted to be plugged into an electrical socket in order to supply electrical power to the air conditioner is provided. The air conditioner control assembly includes a control unit having an electrical plug adapted to be plugged into an electrical power socket in a home, an electrical socket adapted to receive the electrical plug of the air conditioner, and a relay electrically connected between the two to selectively relay electrical power from the electrical power socket in a home to the air conditioner in response to a control signal. A thermostat located remotely from the control unit and from the air conditioner is electrically connected to the control unit, the thermostat generating the control signals to which the relay is responsive as a function of temperature sensed by the thermostat and time of day.

14 Claims, 4 Drawing Sheets

REMOTE THERMOSTAT FOR ROOM AIR CONDITIONER

RELATED APPLICATIONS

This patent application claims the benefit of, under Title 35, United States Code, Section 119(e), U.S. Provisional Patent Application No. 60/396,215, filed Jul. 16, 2002.

FIELD OF THE INVENTION

The present invention relates to a thermostatic control device which can be used with traditional window-type room air conditioners to provide enhanced temperature control thereof.

BACKGROUND OF THE INVENTION

Traditional window-type room air conditioners typically include a very basic thermostatic control mechanism which suffers from a number of disadvantages. One such disadvantage is that while the refrigerant compressor starts and stops to regulate the temperature of the room, the unit's fan does not. Thus, when the room is too warm the fan will continue to run even if the desired room temperature has been met. This thermostatic control method is inefficient from an energy usage standpoint, causes needless noise, and may result in overcooling of the room if, for example, it becomes cooler outdoors than the desired indoor temperature.

Another disadvantage of traditional thermostatic control mechanisms is that the temperature sensor is typically located in the air intake. This is where the temperature of the room is sampled, and where it is determined whether further cooling is necessary to achieve the desired temperature. If it gets cool outside during the night, for example, the air conditioner will continue to run in fan only mode, the compressor off, in an attempt to moderate the rooms temperature. The body of the unit will become cool and in effect it will cause the room to get cooler than is desired.

While some traditional window-type air conditioners do include some sort of advanced thermostatic controls which do stop and start the fan as an option, it is only the newest and most expensive units which do so. Moreover, even these units monitor the room's temperature through the intake air vent. However, this is also flawed since this thermostat is designed to measure the temperature of air passing by it. When the fan is off the unit is slow to respond to temperature demand and as a result does not work well.

Various attempts have been made to obviate the above problems, each attempt having met with varying degrees of success. U.S. Pat. No. 3,486,081, for example, discloses a thermostatic switch and adapter assembly for controlling the operation of an electrical heater or air conditioner unit as a function of temperature in a region remote from the unit. The assembly comprises an adapter box and a remote thermostatic switch connected to the box via a relatively light, two-wire extension line which may be of any desired length. The thermostatic switch is mounted at any desired position in the room and can be of the usual bimetallic design. The thermostat also includes a regulator knob to adjust the position of a fixed contact with respect to the moveable element, thereby to fix the temperature setting at which the switch closes.

U.S. Pat. No. 3,785,165 similarly discloses a thermostatic air conditioner control for use with individual unit air conditioners having a thermostatic switch disposed at a location remote from the air conditioner. The control includes circuitry interposed between the air conditioner and a source of electrical energy operative a selected time interval after closure of said thermostatic switch to energize a socket in which the air conditioner is plugged, and operative a selected time interval after opening of said thermostatic switch to de-energize the socket.

While U.S. Pat. Nos. 3,486,081 and 3,785,165 did obviate many of the above-described problems associated with the prior art, numerous problems with the prior art were not addressed thereby.

One such problem concerns the lack of an automatic "set-back" function. For ideal comfort or for energy conservation reasons, it is common practice to reduce the degree of cooling or heating during periods of minimum activity, for example during nighttime or at other times of minimum activity, according to comfort requirements. For example, the ambient temperature in a home can be reduced significantly at night when the occupants are asleep without causing any discomfort. Additionally, the temperature can be reduced substantially during the day when the dwelling is not occupied. Such a reduction in the nighttime temperature of the dwelling is referred to as a "set-back" which results in a significant reduction in fuel consumption and heating or cooling costs for the dwelling. With the conventional thermostats described above, such temperature set-backs are required to be carried out manually. The need to manually alter the regulated temperature is subject to the human failure of forgetting to change the thermostatic setting whereby cost savings are lost. Also, manual alteration of the regulated temperature is not entirely satisfactory since the dwelling will be uncomfortably cool in the morning before it is manually reset and, due to the lag time of typical heating systems, time is required for the temperature of the dwelling to rise to a comfortable level for normal daytime activities.

While automatic set-back has been provided by thermostats used in conjunction with higher-scale, feature-rich HVAC systems, such features have never been incorporated in the retro-fit type thermostatic control device which can be used with traditional window-type room air conditioners with which the present application is concerned.

Another problem with the systems disclosed in the above-referenced patents relates the lack of important safety features that inhibit potential fire and use of the device on an air conditioner of a size too large for the intended use. There is nothing preventing a user from plugging an air conditioner twice the size of the units' rating into the thermostatic control device. The prior art devices rely upon the wall outlet's circuit breaker which is in the main breaker box of the house to prevent overload. This breaker could require two or three more times the power to cause it to go on safety and as a result the prior art devices would receive more current than they are designed to receive and subsequently fail. Another condition that can happen is that the air conditioner itself could fail and cause a short circuit. The short may not be enough to cause the main circuit breaker to fail, but just enough to overpower the device and cause a catastrophic failure (i.e., a fire).

What is desired therefore, is an air conditioner control assembly for use with a room air conditioner which can be used with inexpensive units and/or with units already owned by the user, which accurately controls the temperature within the room, which is efficient from an energy usage standpoint and does not cause needless noise, and which does not rely on an air sample taken at the unit's air inlet, which allows for automatic set-back control to provide improved comfort control and energy conservation, and which incorporates safety features that inhibit potential fire and overload of the control assembly.

SUMMARY OF THE INVENTION

Accordingly, it is an object of the present invention to provide an air conditioner control assembly for use with a room air conditioner which can be used with inexpensive units and/or with units already owned by the user.

Another object of the present invention is to provide an air conditioner control assembly having the above characteristics and which accurately controls the temperature within the room.

A further object of the present invention is to provide an air conditioner control assembly having the above characteristics and which is efficient from an energy usage standpoint and does not cause needless noise.

Yet a further object of the present invention is to provide an air conditioner control assembly having the above characteristics and which does not rely on an air sample taken at the unit's air inlet.

Yet still a further object of the present invention is to provide an air conditioner control assembly having the above characteristics and which allows for automatic setback control to provide improved comfort control and energy conservation.

Still a further object of the present invention is to provide an air conditioner control assembly having the above characteristics and which incorporates safety features that inhibit potential fire and overload of the control assembly.

These and other objects of the present invention are achieved in one embodiment by provision of an air conditioner control assembly for use with a room air conditioner having an electrical plug adapted to be plugged into an electrical socket in order to supply electrical power to the room air conditioner. The air conditioner control assembly includes a control unit having an electrical plug adapted to be plugged into an electrical power socket in a home, an electrical socket adapted to receive the electrical plug of the room air conditioner, and a relay electrically connected between the electrical plug of the control unit and the electrical socket of the control unit to selectively relay electrical power from the electrical power socket in a home to the room air conditioner in response to a control signal. A thermostat located remotely from the control unit and from the room air conditioner is electrically connected to the control unit, the thermostat generating the control signals to which the relay is responsive as a function of temperature sensed by the thermostat and time of day.

In some embodiments, the control signals generated by the thermostat are generated as a function of temperature sensed by the thermostat, time of day and day of the week. In certain embodiments, the control unit further comprises a circuit breaker for preventing electrical power from the electrical power socket in a home to be supplied to the room air conditioner if the room air conditioner attempts to draw power above a threshold level. In certain of these embodiments, the circuit breaker is capable of being reset to again allow electrical power from the electrical power socket in a home to be supplied to the room air conditioner until the threshold level is again reached. In some of these embodiments, the control unit further comprises an indicator for indicating when the circuit breaker has been tripped. The indicator comprises an LED in some embodiments.

In another embodiment of the present invention, an air conditioner control assembly for use with a room air conditioner having an electrical plug adapted to be plugged into an electrical socket in order to supply electrical power to the room air conditioner, includes a control unit comprising an electrical plug adapted to be plugged into an electrical power socket in a home, an electrical socket adapted to receive the electrical plug of the room air conditioner, a relay electrically connected between the electrical plug of the control unit and the electrical socket of the control unit to selectively relay electrical power from the electrical power socket in a home to the room air conditioner in response to a control signal. A circuit breaker is provided for preventing electrical power from the electrical power socket in a home to be supplied to the room air conditioner if the room air conditioner attempts to draw power above a threshold level. A thermostat located remotely from the control unit and from the room air conditioner is electrically connected to the control unit, the thermostat generating the control signals to which the relay is responsive as a function of temperature sensed by said thermostat.

In some embodiments, the circuit breaker is capable of being reset to again allow electrical power from the electrical power socket in a home to be supplied to the room air conditioner until the threshold level is again reached. In certain of these embodiments, the control unit further comprises an indicator for indicating when the circuit breaker has been tripped. The indicator comprises an LED in some embodiments.

In some embodiments, the control signals generated by the thermostat are generated as a function of temperature sensed by the thermostat and time of day. In some embodiments, the control signals generated by the thermostat are generated as a function of temperature sensed by the thermostat, time of day and day of the week.

In still another embodiment of the present invention, an air conditioner control assembly for use with a room air conditioner having an electrical plug adapted to be plugged into an electrical socket in order to supply electrical power to the room air conditioner includes a control unit comprising an electrical plug adapted to be plugged into an electrical power socket in a home, an electrical socket adapted to receive the electrical plug of the room air conditioner, a relay electrically connected between the electrical plug of the control unit and the electrical socket of the control unit to selectively relay electrical power from the electrical power socket in a home to the room air conditioner in response to a control signal, and a circuit breaker for preventing electrical power from the electrical power socket in a home to be supplied to the room air conditioner if the room air conditioner attempts to draw power above a threshold level. The circuit breaker is capable of being reset to again allow electrical power from the electrical power socket in a home to be supplied to the room air conditioner until the threshold level is again reached. A thermostat located remotely from the control unit and from the room air conditioner is electrically connected to the control unit, the thermostat generating the control signals to which the relay is responsive as a function of temperature sensed by the thermostat, time of day and day of the week.

In some embodiments, the control unit further comprises an indicator for indicating when the circuit breaker has been tripped. The indicator comprises an LED in certain embodiments The invention and its particular features and advantages will become more apparent from the following detailed description considered with reference to the accompanying drawings.

DETAILED DESCRIPTION OF THE EMBODIMENT OF THE INVENTION

Figure 1:
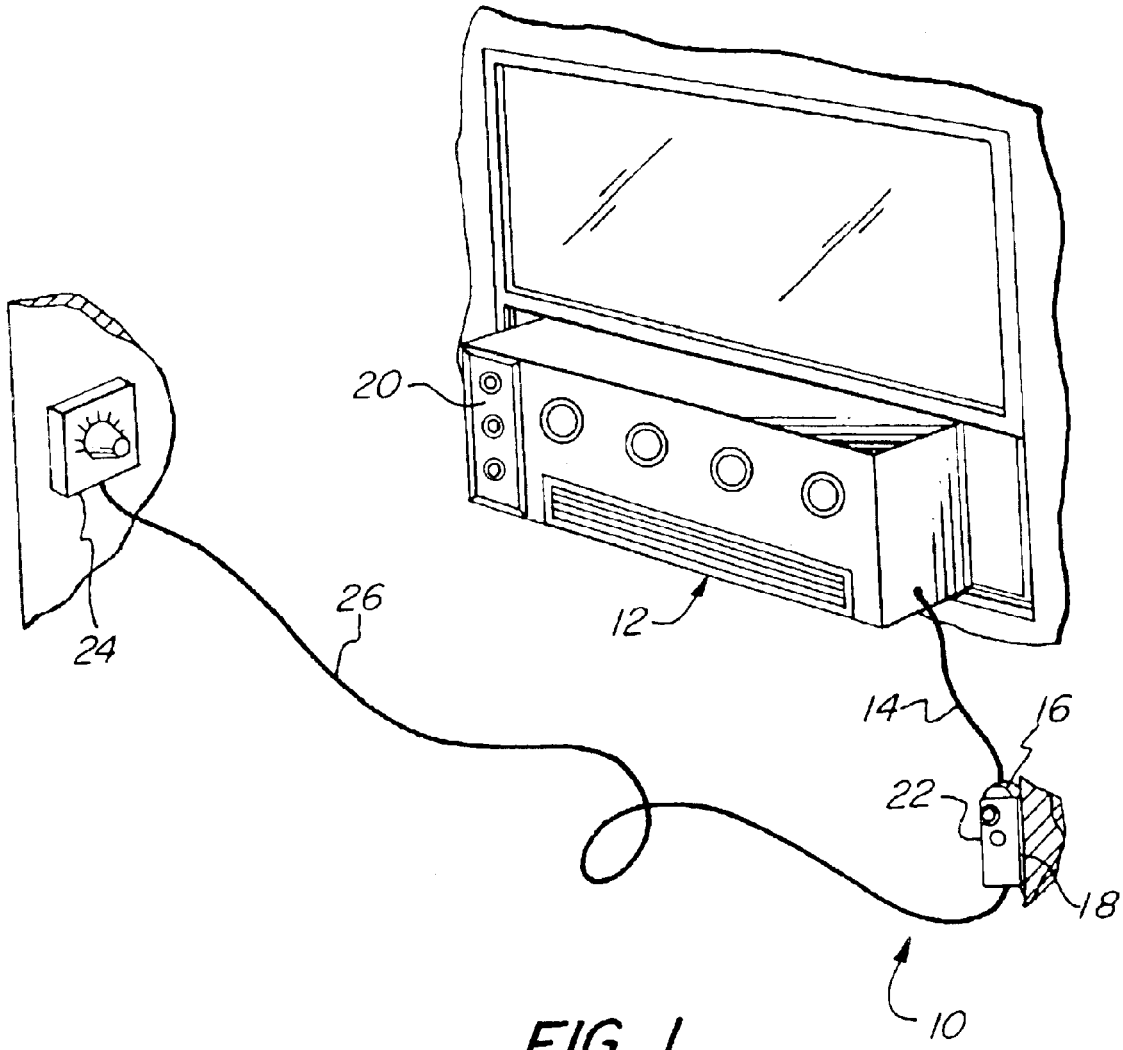
FIG. 1 is a perspective view of an embodiment of an air conditioner control assembly in accordance with the present invention shown installed for use with a room air conditioner.

Referring to FIG. 1, an air conditioner control assembly 10 for a room air conditioner 12 mounted in a window in accordance with the present invention is shown. The room air conditioner 12 has a power line 14 provided with a male plug 16 which normally would be inserted in an typical AC power socket 18. The room air conditioner 12 may or may not be provided with thermostatic controls 20 of its own as is known in the art. If such thermostatic controls 20 are provided, they will be set to a temperature lower than a lowest desired room temperature, so as not to interfere with operation of air conditioner control assembly 10.

Air conditioner control assembly 10 includes a control unit 22 and a remote thermostat 24 connected to control unit 22. Remote thermostat 24 may be connected to control unit 22 via a wire 26, typically a low voltage type wire, or may be wireless. Wire 26 may be of substantially length, it being recognized that it is desirable for wire 26 to have sufficient length to allow thermostat 24 to be mounted in the room away from the room air conditioner 12 in order for a more accurate temperature and demand for cooling to be recognized—the control unit 22 will start and stop the room air conditioner 12 completely based upon the temperature that is desired in the room (and not just the area proximate to the room air conditioner 12).

Figure 2:
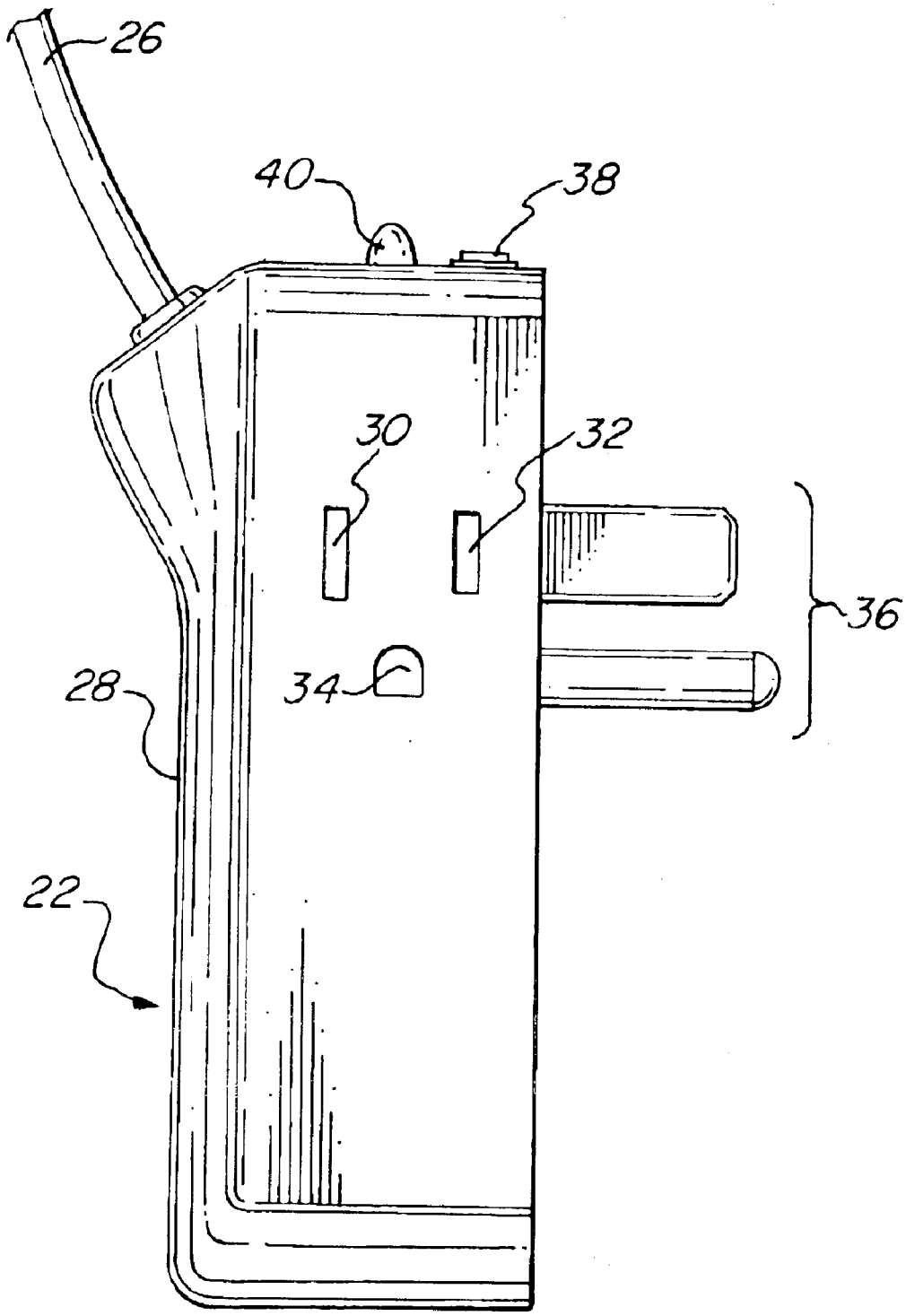
FIG. 2 is a side elevational view of an embodiment of a control unit portion of the air conditioner control assembly of FIG. 1.

Referring now to FIG. 2, control unit 22 includes an outer housing 28 preferably formed of a non-conductive thermally insulating plastic or a strong thermo-set plastic material. The outer housing 28 defines a chamber dimensioned to receive the electrical components of the device (as described more fully below). Housing 28 is formed having ports 30, 32, 34 therein to facilitate communication between plug 16 of room air conditioner 12 and a pair of output sockets supported within the housing 28, as will be described below. Protruding out of housing 28 is an electrical plug 36 adapted to be plugged into the electrical power socket 18 in a home.

In the case where air conditioner control assembly 10 also includes an internal circuit breaker 37 of its own, control unit 22 may be provided with a reset button 38 which pops out when tripped and can be pushed in (as shown in FIG. 2) in order to re-set the circuit breaker 37 in the functioning position. An indicator 40, such as an LED may be provided which would light up when the circuit breaker 37 has tripped to indicate an over power condition.

Figure 3:
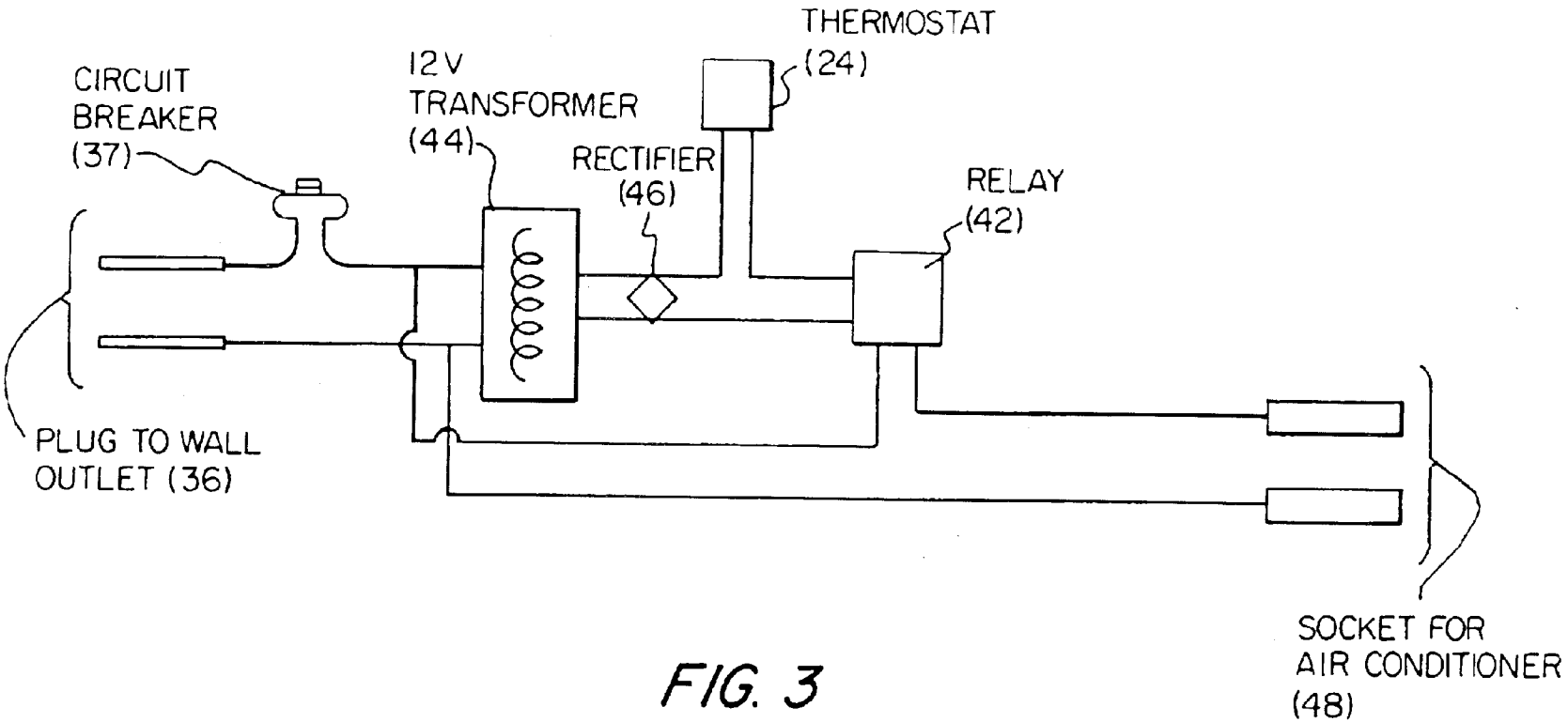
FIG. 3 is schematic drawing illustrating the electrical components of the control unit portion of the air conditioner control assembly of FIG. 1.

Referring now to FIG. 3, the electrical components of the control unit 22 are schematically shown. Control unit 22 includes a relay 42 that is responsive to control signals received from thermostat 24. The thermostat 24 may comprise a 12 volt DC thermostat, in which case a 12 volt transformer 44 and a rectifier 46 may also be provided. Employing other voltages (e.g., 24 volts) is, of course, also possible. Relay 42 is electrically connected between electrical plug 36 protruding out of housing 28 and an electrical socket 48 (positioned within housing 28 adjacent ports 30, 32, 34) and adapted to receive plug 16 of room air conditioner 12. Relay 42 thereby selectively relays electrical power from the electrical power socket 18 in a home to the room air conditioner 12 in response to a control signal received from thermostat 24. Circuit breaker 37 is connected between relay 42 and electrical socket 36.

Air conditioner control assembly 10 will thus control power to a common window-type room air conditioner 12 through the use of the relay 42 and thermostat 24. It will make the room air conditioner 12 function better by being capable of reading the cooling needs of a room more efficiently. This is accomplished in part by starting and stopping the electrical current from the wall to the window air conditioner unit based upon need.

It should be noted that one can use the air conditioner control assembly 10 of the present invention with a currently owned air conditioning unit, provided that the amperage draw does not exceed the device's capacity. Moreover, if one is purchasing a new window air conditioning unit he/she can purchase the basic model in his/her desired capacity and use the control unit of the present invention to control the room's temperature. This would save the consumer money over the cost of an expensive, yet still flawed, computer driven window air conditioning unit.

Although formal studies have not yet been conducted regarding this issue, common sense dictates that an air conditioning unit which completely shuts off uses less electricity than one that is operating in the fan only mode, which is the traditional window-type air conditioning unit's way of regulating the room temperature when it senses the room is too cool and only shuts the refrigerant compressor off.

Figure 4:
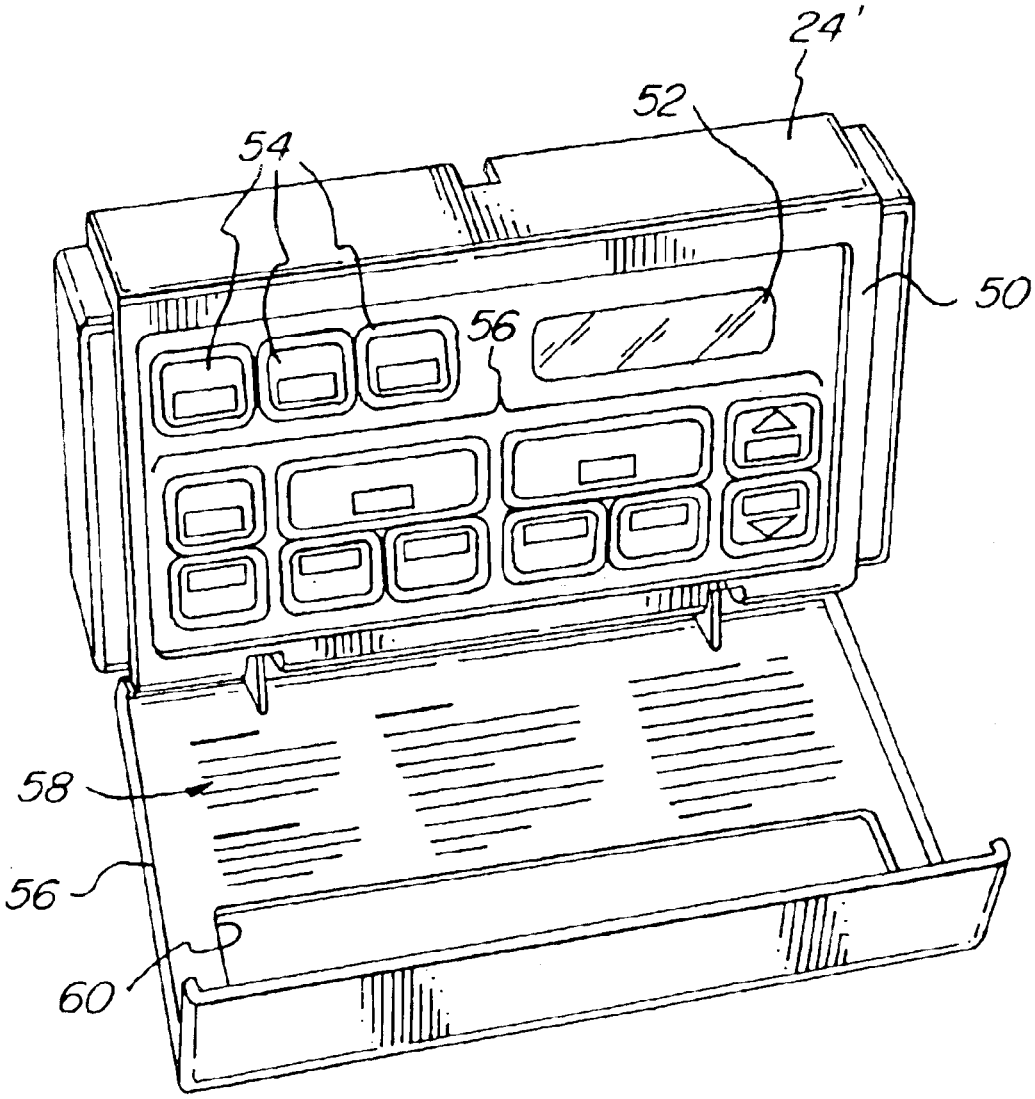
FIG. 4 is a perspective view of an embodiment of a thermostat portion of the air conditioner control assembly of FIG. 1.

Thermostat 24 in certain embodiments may comprise a simple bi-metallic thermostat of conventional design having a regulator knob(as shown in FIG. 1), slide or the like to adjust the position of the fixed contact with respect to the movable element, thereby fixing the temperature setting at which the switch closes. However, as best seen in FIG. 4, thermostat 24' may have a more advanced design with greater functionality.

Thermostat 24' may for example, comprise a programmable electronic digital thermostat. Electronic digital thermostat 24' has a generally rectangular housing 50 having a liquid crystal display (LCD) 52 for displaying time, temperature, day of week and system indicators, a first group of key switches 54 disposed beside the LCD 18 for entering program override commands and a second group of key switches 22 for entering time and temperature schedule data and for entering selected modes of operation. A hinged door 56 carrying printed programming instructions 58 on its inside face for assisting the user in entering time and temperature schedule data is shown in an open position. During normal operation the door 56 covers the second group of key switches 54 with the LCD display 52 and the first group of key switches 54 aligned with an aperture 60 within the door 56.

Employing a programmable electronic digital thermostat 24' allows a user to set different temperature set points for different portions of the day. For example, one set point may be set for daytime, with another set point for nighttime. If desired, even more programmable set points may be capable of being programmed. For example, it may be desirable to have a morning set point (e.g., when inhabitants wake up in the morning), a midday set point (e.g., when inhabitants are out of the house at work), an evening set point (e.g., when inhabitants have returned from work) and a night set point (e.g., when inhabitants are sleeping). It is also possible to have different set points for different days of the week. For example, a different schedule may be desired for weekends (e.g., when many inhabitants do not work), or for other days of the week when inhabitants may have differing schedules. It may also be desirable to provide override controls to allow inhabitants to override the program if for whatever reason it is not desired to maintain the program at a particular time.

Because programmable electronic digital thermostats are known in the art (for use in conjunction with higher-scale, feature-rich HVAC systems), a detailed configuration and operation thereof is not presented herein.

It is also contemplated that the thermostatic 24 of the present invention may be created in a wireless model. This model would operate in the same way and perform the same function as noted above. The only difference is that the external thermostat would be cordless.

It is also contemplated that with the flick of a thermostat-reversing switch, the air conditioner control assembly 10 of the present invention can be used with a portable heater, thereby providing the same function of controlling the temperature in a room.

The present invention, therefore, provides an air conditioner control assembly for use with a room air conditioner which can be used with inexpensive units and/or with units already owned by the user, which accurately controls the temperature within the room, which is efficient from an energy usage standpoint and does not cause needless noise, and which does not rely on an air sample taken at the unit's air inlet, which allows for automatic set-back control to provide improved comfort control and energy conservation, and which incorporates safety features that inhibit potential fire and overload of the control assembly.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An air conditioner control assembly for use with a room air conditioner having an electrical plug adapted to be plugged into an electrical power socket in order to supply electrical power to the room air conditioner, said air conditioner control assembly comprising:

a control unit comprising:

an electrical plug adapted to be plugged into the electrical power socket in a home;

an electrical socket adapted to receive the electrical plug of the room air conditioner; and a relay electrically connected between said electrical plug of said control unit and said electrical socket of said control unit to selectively relay electrical power from the electrical power socket in a home to the room air conditioner in response to a control signal;

a circuit breaker for interrupting supply of electrical power from the electrical power socket to the room air conditioner when the power usage by the air conditioner exceeds a threshold thermal level;

a thermostat located remotely from said control unit and from the room air conditioner and electrically connected to said control unit, said thermostat generating the control signals to which said relay is responsive as a function of temperature sensed by said thermostat and time of day.

2. The air conditioner control assembly of claim 1 wherein the control signals generated by said thermostat are generated as a function of temperature sensed by said thermostat, time of day and day of the week.

3. The air conditioner control assembly of claim 1 wherein said circuit breaker is capable of being reset to again allow electrical power from the electrical power socket in a home to be supplied to the room air conditioner until the threshold level is again reached.

4. The air conditioner control assembly of claim 1 wherein said control unit further comprises an indicator for indicating when said circuit breaker has been tripped.

5. The air conditioner control assembly of claim 4 wherein said indicator comprises an LED.

6. An air conditioner control assembly for use with a room air conditioner having an electrical plug adapted to be plugged into an electrical socket in order to supply electrical power to the room air conditioner, said air conditioner control assembly comprising:

a control unit comprising:

an electrical plug adapted to be plugged into an electrical power socket in a home;

an electrical socket adapted to receive the electrical plug of the room air conditioner;

a relay electrically connected between said electrical plug of said control unit and said electrical socket of said control unit to selectively relay electrical power from the electrical power socket in a home to the room air conditioner in response to a control signal; and a circuit breaker for preventing electrical power from the electrical power socket in a home to be supplied to the room air conditioner if the room air conditioner attempts to draw power above a threshold level; and a thermostat located remotely from said control unit and from the room air conditioner and electrically connected to said control unit, said thermostat generating the control signals to which said relay is responsive as a function of temperature sensed by said thermostat.

7. The air conditioner control assembly of claim 6 wherein said circuit breaker is capable of being reset to again allow electrical power from the electrical power socket in a home to be supplied to the room air conditioner until the threshold level is again reached.

8. The air conditioner control assembly of claim 6 wherein said control unit further comprises an indicator for indicating when said circuit breaker has been tripped.

9. The air conditioner control assembly of claim 8 wherein said indicator comprises an LED.

10. The air conditioner control assembly of claim 6 wherein the control signals generated by said thermostat are generated as a function of temperature sensed by said thermostat and time of day.

11. The air conditioner control assembly of claim 10 wherein the control signals generated by said thermostat are generated as a function of temperature sensed by said thermostat, time of day and day of the week.

12. An air conditioner control assembly for use with a room air conditioner having an electrical plug adapted to be plugged into an electrical socket in order to supply electrical power to the room air conditioner, said air conditioner control assembly comprising:

a control unit comprising:

an electrical plug adapted to be plugged into an electrical power socket in a home;

an electrical socket adapted to receive the electrical plug of the room air conditioner;

a relay electrically connected between said electrical plug of said control unit and said electrical socket of said control unit to selectively relay electrical power from the electrical power socket in a home to the room air conditioner in response to a control signal; and a circuit breaker for preventing electrical power from the electrical power socket in a home to be supplied to the room air conditioner if the room air conditioner attempts to draw power above a threshold level, wherein said circuit breaker is capable of being reset to again allow electrical power from the electrical power socket in a home to be supplied to the room air conditioner until the threshold level is again reached; and a thermostat located remotely from said control unit and from the room air conditioner and electrically connected to said control unit, said thermostat generating the control signals to which said relay is responsive as a function of temperature sensed by said thermostat, time of day and day of the week.

13. The air conditioner control assembly of claim 12 wherein said control unit further comprises an indicator for indicating when said circuit breaker has been tripped.

14. The air conditioner control assembly of claim 13 wherein said indicator comprises an LED.

* * * * *